US005217777A

United States Patent [19]

Parkinson et al.

[11] Patent Number: 5,217,777

[45] Date of Patent: Jun. 8, 1993

[54] PROTECTIVE FILM ASSEMBLY AND METHOD OF MAKING THE SAME

[75] Inventors: William S. Parkinson, Dallas; Arthur W. Voirin, Nacogdoches, both of Tex.

[73] Assignee: Bunker Plastics, Grand Saline, Tex.

[21] Appl. No.: 606,516

[22] Filed: Oct. 31, 1990

Related U.S. Application Data

[63] Continuation of Ser. No. 310,939, Feb. 16, 1989, abandoned.

[51] Int. Cl.[5] ..... B32B 3/08; B32B 7/06

[52] U.S. Cl. ..... 428/64; 428/77; 428/220; 428/339; 428/343; 428/908.8; 428/912.2

[58] Field of Search ..... 428/64, 77, 78, 79, 428/80, 343, 908.8, 220, 339, 912.2; 132/301, 316, 296

[56] References Cited

U.S. PATENT DOCUMENTS

| | | | |
|---|---|---|---|
| 745,195 | 11/1903 | Kimsey | 215/298 |
| 2,366,009 | 12/1944 | De Pasquale | 132/301 |
| 4,685,558 | 8/1987 | Filiz | 132/301 |

FOREIGN PATENT DOCUMENTS 659633 2/1987 Switzerland .

*Primary Examiner*—Jenna L. Davis
*Attorney, Agent, or Firm*—Hopkins & Thomas

[57] ABSTRACT

A protective film assembly including a sheet of protective film having a pull strip assembly attached thereto. The pull strip assembly includes a tab which extends from one edge of the sheet to another edge, allowing the protectivie film assembly to be easily removed from a substrate when the tab is pulled.

11 Claims, 1 Drawing Sheet

PROTECTIVE FILM ASSEMBLY AND METHOD OF MAKING THE SAME

This is a continuation of co-pending application Ser. No. 07/310,939 filed on Feb. 16, 1989, now abandoned.

BACKGROUND OF THE INVENTION

This invention relates to a protective film assembly, and is more particularly concerned with a layer of protective film made of polyethylene or similar material, adapted to cover and protect the surface of a substrate, such as a mirror. The protective film assembly is designed to be easily and readily removed from the surface of the substrate.

It is essential that various products, for example reflective substrates used as mirrors and adapted for installation in women's cosmetic compacts, mirrored dental and surgical instruments, and similar devices, be protected during the product's assembly and packaging. Otherwise, the reflective surface could become scratched or marred in some manner. In the past, various methods have been used to protect the substrate, including by placing various protective coverings over the substrate during manufacture and assembly of the product, and storage awaiting use. It is known that one quick and efficient method of protecting such substrates is to apply a thin sheet or film of polyethylene or similar substance on the reflective surface of the substrate during manufacture and assembly of the product. The advantages of using relatively thin polyethylene include having the substrate effectively protected, while providing a protective assembly which does not interfere with the manufacturing and assembly of the product. The drawbacks, however, include the fact that these prior art protective films are often extremely difficult to remove from the substrate in order to use the product. This is because the polyethylene film is in close contact with the substrate, either by the film being pressure sensitive to allow for adhesion or because of an adhesive substance applied between the substrate and the protective film assembly.

For example, during the assembly of women's cosmetic compacts, the reflective substrate, usually comprised of a vacuum plated polycarbonate, acrylic, or similar substance, is ordinarily covered with the protective film and then cut to the desired size so that the reflective substrate component of the compact already includes the film assembly thereon to protect the component during assembly. The reflective substrate component is then inserted into and received within the body portion of the compact. Before or after the reflective substrate is inserted into the compact, the edges thereof are somewhat inaccessible and, therefore, it is extremely difficult to remove the protective film from the substrate. Even in other, similar applications in which the edges of the substrate are readily accessible, the adhering of the protective film assembly to the substrate makes it very difficult to remove the film assembly therefrom. To-date, no known methods integral to the substrate itself are known, which enable the ready removal of the film assembly from the substrate. The present invention overcomes the disadvantages previously discussed by providing an apparatus for efficiently and easily removing the protective film assembly from the substrate, even when the edges of the substrate are not readily accessible.

SUMMARY OF THE INVENTION

Briefly described, the invention comprises a protective film assembly including a protective sheet or film of polyethylene or similar substance. The polyethylene film is pressure sensitive and is adapted to adhere to a substrate such as a mirror or other smooth surface. Running from one edge of the protective film to another edge is a pull strip assembly having one adhesive surface for attachment to the protective film, and another non-adhesive surface, which forms a pull tab. The adhesive between the pull strip assembly and the protective film is such that when the pull tab is pulled, the protective film will separate from the substrate before the pull strip assembly separates from the protective film.

In making the protective film assembly, the protective film, which is normally stored on a large roll, is applied to the substrate. The pull strip assembly is then applied onto the exposed surface of the protective film. The substrate is then cut into its pattern using, for example, a laser cutter. Simultaneously, the protective film and pull strip assembly are cut along with the substrate, so that the finished product includes a substrate having a protective film covering the surface to be protected, and a pull strip assembly attached to the protective film and running from one edge of the substrate and film, to another edge. Of course, the protective film assembly can be applied to both sides of the substrate and cut in a like manner, if it is deemed desirable to do so.

In the usual, commercial manufacturing operation, for example in the case of assembling women's cosmetic compacts, a large sheet of reflective substrate is covered with protective film. Pull strip assemblies are attached to the protective film, at regular intervals, running from edge to edge across the sheet of substrate. The substrate is then cut into, for example, a circular pattern, many individual assemblies being cut from a single sheet of substrate. These individual units may or may not be stacked in a dispensing tube, depending upon the process used. As the body of the compact passes under the dispensing tube, the substrate assemblies are inserted therein. The presence of the protective film assembly insures that during this manufacturing and assembly process, the reflective substrate is not damaged. When the user uses the compact for the first time, or at the time of insertion in the compact, the protective strip assembly can be easily removed by pulling the tab of the pull strip.

Accordingly, it is an object of the present invention to provide a protective film assembly which is inexpensive to manufacture, durable in structure, and efficient in operation.

Another object of the present invention is to provide a protective film assembly which can be assembled during the manufacturing process of a substrate component.

Another object of the present invention is to provide a protective film assembly which does not interfere with the assembly process of a finished product.

Another object of the present invention is to provide a protective film assembly which is easily and readily removed from a substrate.

Another object of the present invention is to provide a protective film assembly including a sheet of protective film and a pull tab, in which the sheet of protective film separates from an edge of the substrate when the pull tab is pulled, no matter where along of the pull tab the tab is pulled.

Another object of the present invention is to provide a method of making a protective film assembly in which multiple assemblies can be manufactured simultaneously.

Another object of the present invention is to provide a protective film assembly which can be utilized on a variety of different substrates.

Another object of the present invention is to provide a protective film assembly which includes a pull tab adapted to readily fit between a thumb and finger.

Another object of the present invention is to provide a protective film assembly which includes a film of polyethylene adapted to removably adhered to the surface of a substrate by either electrostatic means or by an adhesive substance.

Other objects, features and advantages of the present invention will become apparent from the following description when taken in conjunction with the accompanying drawings, wherein like characters of reference designate corresponding parts throughout the several views.

DESCRIPTION OF THE PREFERRED EMBODIMENTS

Figure 1:
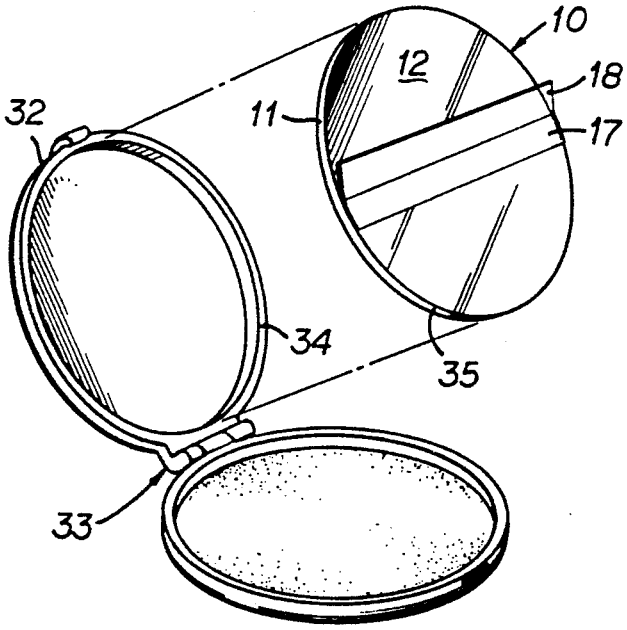
FIG. 1 is a perspective view of the present invention adapted to be received in a women's compact.
Figure 4:
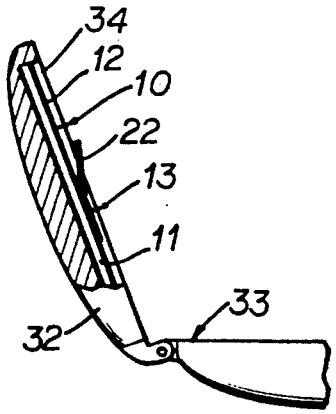
FIG. 4 is a fragmentary view of the present invention received within a women's compact, shown partially in cross-section.

Referring now in detail to the embodiments chosen for illustrating the present invention, the protective film assembly 10 is depicted in FIG. 1 being circular in pattern and being adhered to substrate 11, assembly 10 and substrate 11 being circular and having identical diameters. Assembly 10 includes protective sheet or film 12, which is preferably a clear, plastic resin of polyethylene or similar compound, having a thickness of approximately 0.001 to 0.0015 inches. Disposed along the upper surface of film 12 in diametric relationship therewith is pull strip assembly 13. Strip assembly 13 is comprised of a strip of tape 14 being creased along its longitudinal axis 15 and having a non-tacky upper surface 16 and a tacky, lower surface (not shown) opposite that of surface 16. The longitudinal crease 15 separates tape 14 into adhering portion 17 and pull strip portion 18. The adhesive or tacky surface of adhering portion 17 is applied to the upper surface 19 of film 12, as depicted in FIG. 1. Pull strip assembly 13 also includes tape 20 having non-tacky surface 21 and tacky or adhesive surface (not shown) opposite surface 21 The width of tape 20 is equal to the width of pull strip portion 18. The tacky surface (not shown) of tape 21 is applied against the tacky surface (not shown) of pull strip portion 18, as depicted in FIG. 1, so that an upstanding, non-tacky pull tab 22 is created thereby. Thus, the pull strip assembly 13 runs from edge to edge of the protective sheet 12 and substrate 11. The example depicted in the accompanying drawings is of a protective film assembly adapted to protect a reflective substrate for insertion into a women's cosmetic compact. The reflective substrate in this application is normally approximately 2½ to 3½ inches in diameter. The polyethylene film 12 is attached to substrate 11 either electrostatically or by a mild adhesive. The adhesive (not shown) on the adhesive side of portion 17 is of such strength that when tab 22 is pulled, the film 12 will separate from the substrate 11 before the pull strip assembly 13 separates from the protective film 12. Further it is essential to removing such a protective film 12, that the film 12 be first separated from substrate 11 along one edge of substrate 11. The film 12 cannot be removed manually unless film 12 is first separated from such an edge. The present assembly 10 is designed so that when any portion of tab 22 is pulled, film 12 separates from substrate 11 along the edge of substrate 11.

Figure 5:
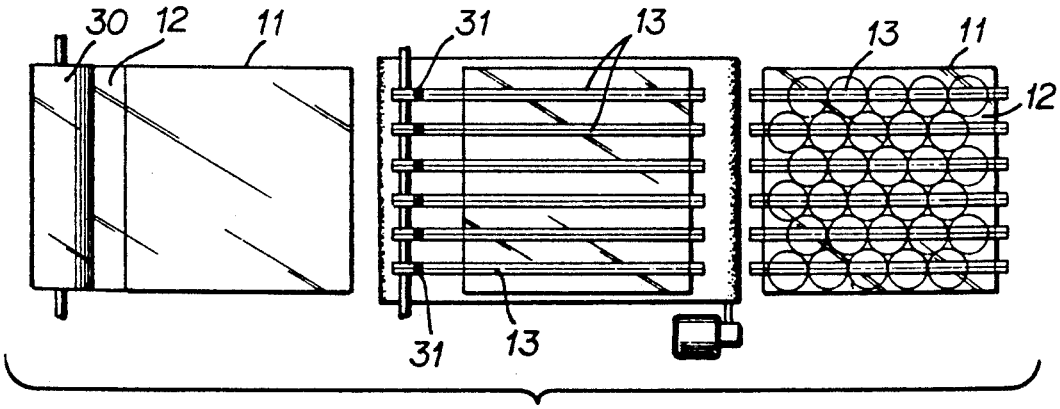
FIG. 5 is a plan view of the present invention being manufactured in three stages.
Figure 3:
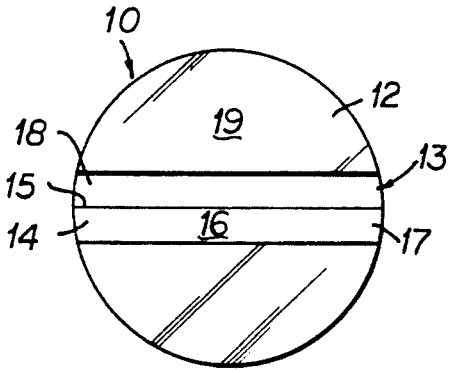
FIG. 3 is an elevated view of the protective film assembly attached to a substrate.
Figure 2:
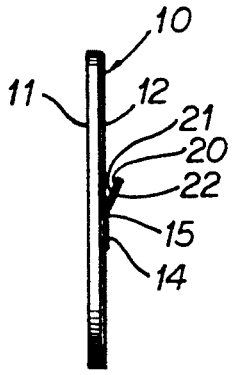
FIG. 2 is an elevated side view of the present invention.

The protective film assembly 10 of this example is manufactured first by disposing a large roll 30 of protective film 12 to contact a sheet of substrate 11. As discussed earlier, the film 12 adheres to the substrate 11 either electrostatically or by a mild adhesive. Rolls 31 of pull strip assemblies 13 are arranged spaced equidistantly from each other and are disposed to contact the upper surface of film 12. The adhesive side (not shown) of adhesive portion 17 of tape 14 is applied to film 12 as shown in FIG. 5, tape 20 already having been applied to pull strip portion 18 in a prior step, as previously discussed. In the next step, the substrate 11, film 12, and pull strip assembly 13 are cut in the desired pattern by, for example, a laser cutter (not shown). It is well known in the art that substrates such as polycarbonate or acrylic materials can be cut into any desired pattern with a laser cutter, therefore, such is not further discussed herein. In the example discussed, the pattern is circular, and as depicted in FIG. 5, the pattern is cut so that the pull strip assembly 13 runs across the diameter of the circular protective film 12 and substrate 11.

In mass production of, for example, mirrored dental or surgical instruments or women's cosmetics compacts, the reflective substrates are normally disposed in stacked relationship in a dispensing tube (not shown) to be inserted into the body of the finished product. FIG. 1 depicts a reflective substrate 11 having a protective film assembly 10, manufactured as described above, aligned for insertion into the reflective cup portion 32 of a women's cosmetic compact 33. Sometimes the reflective cup portion 32 includes an annular flange 34 which, among other functions, operates to assist in retaining substrate 11 in place. It can be seen that when substrate 11 and protective film assembly 10 are received within cup 32, flange 34 will prevent film 12 from being easily removed from substrate 11. This is because the adhesion of film 12 to substrate 11 necessitates that film 12 be removed along its periphery or edge 35. Otherwise, film 12 cannot be easily and effectively removed. This problem is remedied by the presence of pull strip assembly 13. When any portion of pull tab 22 is pulled, film 12 will be removed from substrate 11 along any edge, for example edge 35.

Even when a substrate having a protective film 12 is not received within a device having a flange, such as flange 34, the close adhesion of film 12 to the substrate makes it very difficult to remove the film by hand, without either mechanical means or a pull strip assembly 13, as depicted herein.

It is recognized by those skilled in the art that the above invention is not limited to reflective substrates such as those received within women's cosmetic compacts or reflective dental or surgical instruments, but may also be employed to cover any substrate which can be protected by a polyethylene or like film. It will be further obvious to those skilled in the art that many variations may be made in the embodiments here chosen for the purpose of illustrating the present invention and full, resort may be had to the doctrine of equivalents without departing from the scope of the present invention as defined by the appended claims.

What is claimed is:

1. A protective assembly comprising a mirrored substrate having an outer surface on the outer side of the substrate for producing a reflection of objects disposed adjacent the outer side, said outer surface being essentially flat and continuous, a film having an inner surface and an outer surface, said film extending over the outer surface of the substrate in an overlying relationship, said film being removeably adhered to the outer surface of the substrate, said film forming a protective layer for protecting substantially the entire outer surface of the substrate, and a strip assembly having a securing portion thereof extending across a portion of said outer surface of said film from one edge of the substrate to another edge of the substrate and which is secured thereto and a pull strip portion which can be grasped and lifted away from the substrate for removing said film from the outer surface of the substrate when said pull strip portion is pulled away from the substrate.

2. The assembly defined in claim 1 wherein said film has thickness of approximately 0.001 inches to approximately 0.0015 inches.

3. The assembly defined in claim 1 wherein said film and the substrate are coextensive with each other.

4. The assembly defined in claim 1 wherein said strip assembly is straight and extends substantially across from one edge to the opposite edge of said film, said securing portion of said strip being adhered to said film throughout substantially its entire length.

5. The assembly defined in claim 4 wherein said inner surface of said film is provided with adhesive for removably adhering said film to the outer surface of the substrate.

6. The assembly defined in claim 1 wherein said film is adapted for removably adhering to the outer surface of the substrate by means of electrostatic attraction between said film and the substrate.

7. The assembly defined in claim 1 wherein said film and the substrate are circular and wherein said strip assembly extends diametrically across said outer surface of said film.

8. The assembly defined in claim 7 wherein said securing portion of said strip assembly which is secured to said outer surface of said film is secured thereto throughout substantially the entire length of said strip assembly.

9. A mirrored component comprising:

a substantially flat mirrored substrate having an upper surface; and a protective assembly mounted to said mirrored substrate and including a thin protective film applied to and substantially covering said upper surface of said mirrored substrate, said protective film being removeably adhered to said mirrored substrate, said protective assembly including means for pulling said protective film off said mirrored substrate comprising a pull strip assembly mounted to an upper surface of said protective film and extending across said protective film, said pull strip assembly including an adhesive portion adhered to said protective film and a non-adhesive portion adapted to be grasped for pulling said pull strip assembly and said protective film off said mirrored substrate.

10. A mirrored component as claimed in claim 9 wherein said mirrored substrate is adapted for incorporation into a cosmetic compact.

11. A mirrored component as claimed in claim 9 wherein said mirrored substrate is circular.

* * * * *